US008776269B2

(12) United States Patent
Matsuoka

(10) Patent No.: US 8,776,269 B2
(45) Date of Patent: Jul. 15, 2014

(54) SEWN GLOVE AND MANUFACTURING METHOD THEREOF

(75) Inventor: Koji Matsuoka, Kagawa (JP)

(73) Assignee: Matsuoka Glove Co., Ltd., Higashikagawa-Shi (JP)

( * ) Notice: Subject to any disclaimer, the term of this patent is extended or adjusted under 35 U.S.C. 154(b) by 550 days.

(21) Appl. No.: 12/067,723

(22) PCT Filed: Mar. 7, 2008

(86) PCT No.: PCT/JP2008/054196

§ 371 (c)(1),
(2), (4) Date: May 17, 2010

(87) PCT Pub. No.: WO2009/001582

PCT Pub. Date: Dec. 31, 2008

(65) Prior Publication Data

US 2010/0218303 A1 Sep. 2, 2010

(30) Foreign Application Priority Data

Jun. 25, 2007 (JP) ..... 2007-166524
Nov. 12, 2007 (JP) ..... 2007-293623

(51) Int. Cl.
*A41D 19/00* (2006.01)

(52) U.S. Cl.
USPC ..... 2/163; 2/169

(58) Field of Classification Search
CPC ... A41D 19/00; A41D 19/02; A41D 2400/80; A41D 2300/50
USPC ..... 2/161.1, 161.2, 161.4, 161.5, 161.6, 2/163, 167, 169, 158, 159, 18
See application file for complete search history.

(56) References Cited

U.S. PATENT DOCUMENTS 2,375,961 A * 5/1945 Speight ..... 36/11
3,251,067 A * 5/1966 Shmikler ..... 2/169
4,245,357 A * 1/1981 Connelly ..... 2/163
4,494,249 A * 1/1985 Hansson ..... 2/161.6
6,012,170 A * 1/2000 Kim ..... 2/164
6,732,378 B2 * 5/2004 Novak ..... 2/161.6
2003/0208833 A1 * 11/2003 Gold ..... 2/161.1

FOREIGN PATENT DOCUMENTS

JP 11-076488 A 3/1999
JP 2000-345411 A 12/2000
JP 2002-153409 A 5/2002
JP 3122530 U 6/2006
JP 2007-277801 10/2007

OTHER PUBLICATIONS

Chinese Office Action issued on Mar. 22, 2011 in the corresponding Chinese Patent Application No. 200880019408.6.

Japanese Office Action issued on Jun. 26, 2012 in the corresponding Japanese Patent Application No. 2007-293623.

English language abstract for JP2002-153409 A published May 28, 2002.

* cited by examiner

*Primary Examiner* — Khoa Huynh
*Assistant Examiner* — Anna Kinsaul
(74) *Attorney, Agent, or Firm* — NSQ&M Watchstone LLP

(57) ABSTRACT

A first member and a second member are overlapped to form an overlapping portion (K) and a region including the overlapping portion is sewn in a zigzag manner. The first member is structured by an outer finger-palm portion (104A) and the second member is structured by an inner finger-palm portion (104B), respectively, and at the overlapping portion (K), the inner finger-palm portion (104B) is overlapped on the outer finger-palm portion (104A) or the outer finger-palm portion (104A) is overlapped on the inner finger-palm portion (104B).

1 Claim, 16 Drawing Sheets

(A)

(B)

(A)

(B)

SEWN GLOVE AND MANUFACTURING METHOD THEREOF

CROSS REFERENCE TO RELATED APPLICATIONS

This application claims the benefit of priority date of PCT Patent Application No. PCT/JP2008/054196 filed on Mar. 7, 2008, claiming the benefit of priority date of Japanese Patent Application No. 2007-166524 filed on Jun. 25, 2007, and Japanese Patent Application No. 2007-293623 filed on Nov. 12, 2007, the disclosure of each of which are incorporated herein by reference.

TECHNICAL FIELD

The present invention relates to a sewn glove and a manufacturing method thereof, and, more particularly relates to a sewn glove with a finger pocket portion, which has been bent in advance toward a palm side so that it can easily grasp a ski pole, a motorcycle handgrip, a golf club, a baseball bat, etc., and a manufacturing method of the sewn glove.

BACKGROUND ART

A conventional sewn glove has been disclosed in, for example, a Japanese patent brochure of Utility Model Registration No. 3122530 (a Japanese patent brochure of Patent Application laid-open No. 2007-277801). The sewn glove is structured by a palm member 1 (see FIG. 1 in the patent document 1), a hand-back member 2, and a thumb pocket member 3 as a whole.

Further, each of finger-palm members 12 on the palm member 1 side (for example, see FIG. 6 to FIG. 8 in the patent brochure) is formed by a plurality of divided finger-palm members 17 and then in a state where each divided finger-palm member 17 is bent into a U-shape (see FIG. 7 (C9) in the patent brochure), concave-arc-shaped edges 17*a* and 17*b* in opposition to each other are sewn together (FIG. 8 in the patent brochure) and thus the entire finger pocket can be bent toward the palm side at positions corresponding to interphalangeal joint portions Fa.

As described above, in the conventional technique, in the state where each divided finger-palm member 17 is bent into a U-shape (see FIG. 7 (C) in the patent brochure), the concave-arc-shaped edges 17*a* and 17*b* in opposition to each other are sewn together (FIG. 8 in the patent brochure) and thus the entire finger pocket can be bent toward the palm side at the positions corresponding to the interphalangeal joint portions Fa.

As this state is viewed from the palm side, as shown in FIG. 1 in the present application, the outer divided finger-palm member 17 and the inner divided finger-palm member 17 are overlapped and an overlapping portion K is sewn with thread S.

In this case, however, the overlapping portion K is sewn with the thread S linearly in the horizontal direction (X-axis direction).

Consequently, the elasticity of the overlapping portion K reduces and therefore when the conventional sewn glove is put on a hand, the overlapping portion K will not extend so that it fits the finger.

As a result, there is a demand to make the conventional sewn glove more comfortable to wear when put on a hand. That is, when the conventional sewn glove is put on a hand, as shown in FIG. 2 in the present application, external forces f1 and f2 in the horizontal direction (X-axis direction) are applied to the overlapping portion K from a finger F of the hand with the seams on both ends of the entire straight thread S as the application points a and b.

In this case, the divided finger-palm member 17 forming the overlapping portion K is made of cloth or skin in general, and therefore, it is very flexible and ready to bend.

However, the thread S with which the overlapping portion K is sewn together, is structured only by straight parts S7 to S10 parallel to the X-axis direction.

Therefore, the overlapping portion K is hard to extend further than the current state due to the straight thread S even though it tries to extend in the horizontal direction when the external forces f1 and f2 are applied to the overlapping portion K from the finger F of the hand.

As a result, there is a demand for a sewn glove that is easier and more comfortable to wear when put on a hand, as described above.

The present invention has been developed in order to solve the above-mentioned problem and an object of the present invention is to provide a sewn glove and a manufacturing method thereof capable of making the sewn glove in a state of bending the sewn glove so that the sewn glove fits the fingers of the hand, thereby enabling to wear the sewn glove easier and more comfortable when put on the hand.

DISCLOSURE OF THE INVENTION

In order to achieve the above object, a first aspect of the present invention provides a sewn glove including: a first member 104A, a second member 104B, and the overlapping portion K at which the first member 104A and the second member 104B are overlapped. With the above structure, a region including the overlapping portion K is sewn in a zigzag manner.

A second aspect of the present invention provides a manufacturing method of a sewn glove including steps of (1) overlapping the first member 104A and the second member 104B; and then (2) sewing a region including the overlapping portion K in a zigzag manner.

According to the structure of the present invention, for example, the first member 104A is structured by the outer finger-palm portion 104A (for example, the first finger-palm portion 104A of the index finger) and the second member 104B is structured by the inner finger-palm portion 104B (for example, the second finger-palm portion 104B of the index finger), respectively (FIG. 3), and then, for example, the overlapping portion K is formed by overlapping the inner finger-palm portion 104B on the outer finger-palm portion 104A (FIG. 4(A)), and at the same time, only the overlapping portion K is sewn in a zigzag manner (FIG. 6(A)). As a result, as shown in FIG. 9, because an elastic movement mechanism is formed by inclined parts S1, S2, and S3, and S4, S5, and S6 of the sewn thread S, when such a sewn glove is put on a hand, the external forces f1 and f2 in the horizontal direction (X-axis direction) are applied from the finger F of the hand to the overlapping portion K formed by the finger-palm portions 104A and 104B, which are generally made of cloth or skin as conventionally and excellent in flexibility, with the seams on both ends of the entire thread S forming the elastic movement mechanism as the application points a and b, and therefore, the inclined parts S1, S2, and S3 move to the right and the inclined parts S4, S5, and S6 move to the left with a seam N in the center of the thread S as a center c, allowing a right-side part m1 and a left-side part m2 of the flexible overlapping portion K to move in the horizontal direction (X-axis direction).

A third aspect of the present invention provides a sewn glove with finger pockets, which have been bent in advance toward a palm side, wherein the finger pocket is sewn using a finger-back member that covers the finger-back surface and finger-palm members having a width wide enough to cover the finger-palm surface and right and left sides, respectively, in a position of the finger-palm member corresponding to an interphalangeal joint portion, a substantially elliptic hole is formed, which has a shape in which concave-arc-shaped edges are arranged in opposition to each other, except for each part left uncut on both edges of the finger-palm member, and by sewing together the concave-arc-shaped edges of the substantially elliptic hole in a zigzag manner along each of the concave-arc-shaped edges, a whole finger pocket including the finger-back member is bent toward the palm side.

A fourth aspect of the present invention provides a sewn glove with finger pockets, which have been bent in advance toward a palm side, wherein the finger pocket is sewn using a finger-back member that covers the finger-back surface and finger-palm members having a width wide enough to cover the finger-palm surface and right and left sides, respectively, the finger-palm member is divided into a plurality of divided finger-palm members at positions corresponding to interphalangeal joint portions and the divided portion edge of each of the divided finger-palm members is formed into the concave-arc-shaped edge, respectively, and by sewing together the divided finger-palm members in a zigzag manner along each concave-arc-shaped edge, a whole finger pocket including the back-finger member is bent toward the palm side.

As described above, according to the present invention, when the sewn glove is put on a hand, the whole overlapping portion K can move and because of this, there is an effect that the sewn glove becomes easier and more comfortable to wear by bending the sewn glove so that it fits the fingers of the hand.

BEST MODES FOR CARRYING OUT THE INVENTION

Figure 3:
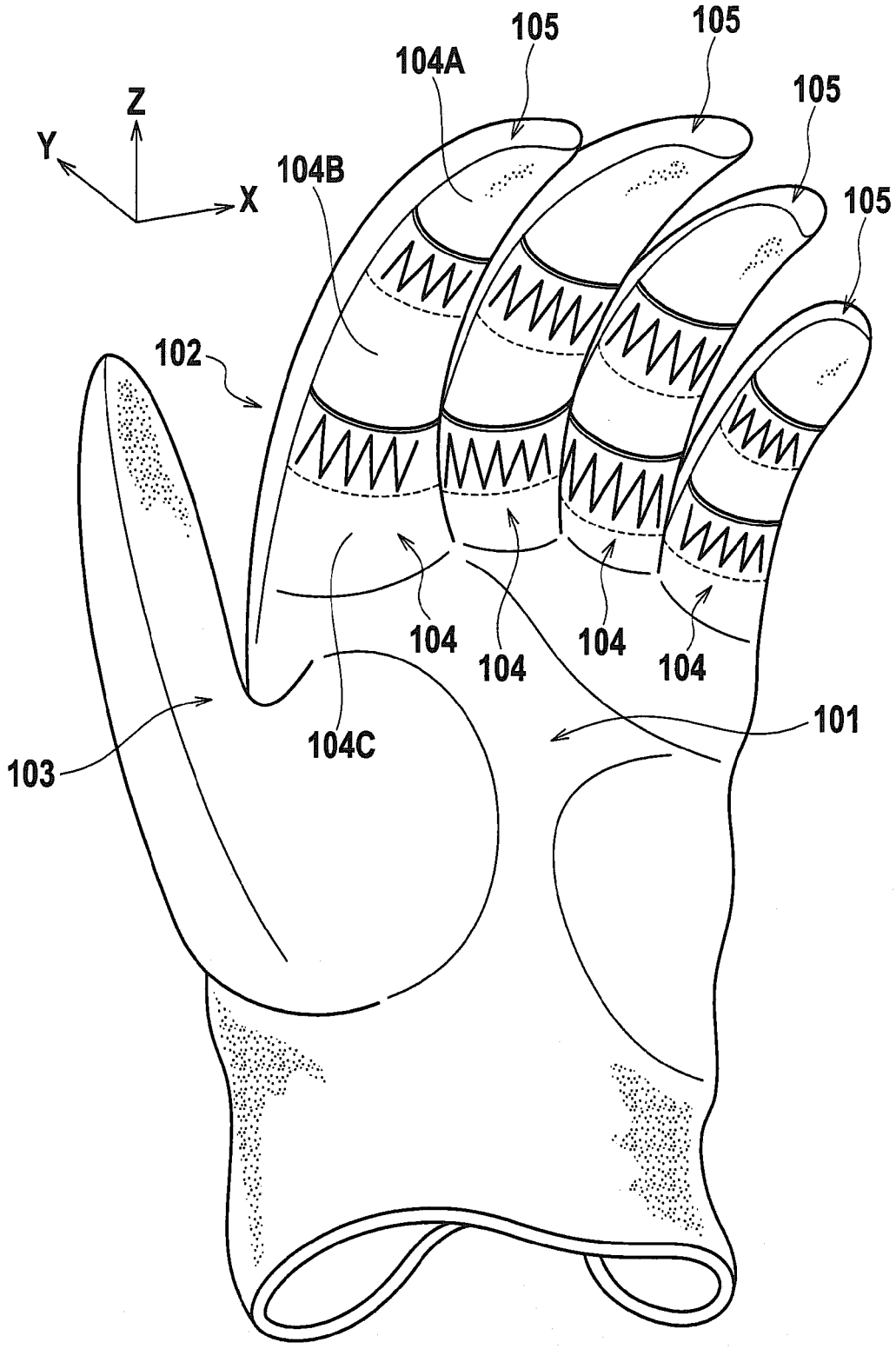
FIG. 3 is a perspective view showing a sewn glove according to the present invention.

The present invention will be explained below by embodiments with reference to the accompanying drawings. FIG. 3 is a perspective view showing a sewn glove according to the present invention.

In FIG. 3, the sewn glove according to the present invention is, as a whole, structured by a palm member 101, a hand-back member 102, and a thumb pocket member 103 and used to grasp, for example, a ski pole, a motorcycle handgrip, a golf club, or a baseball bat.

Figure 2:
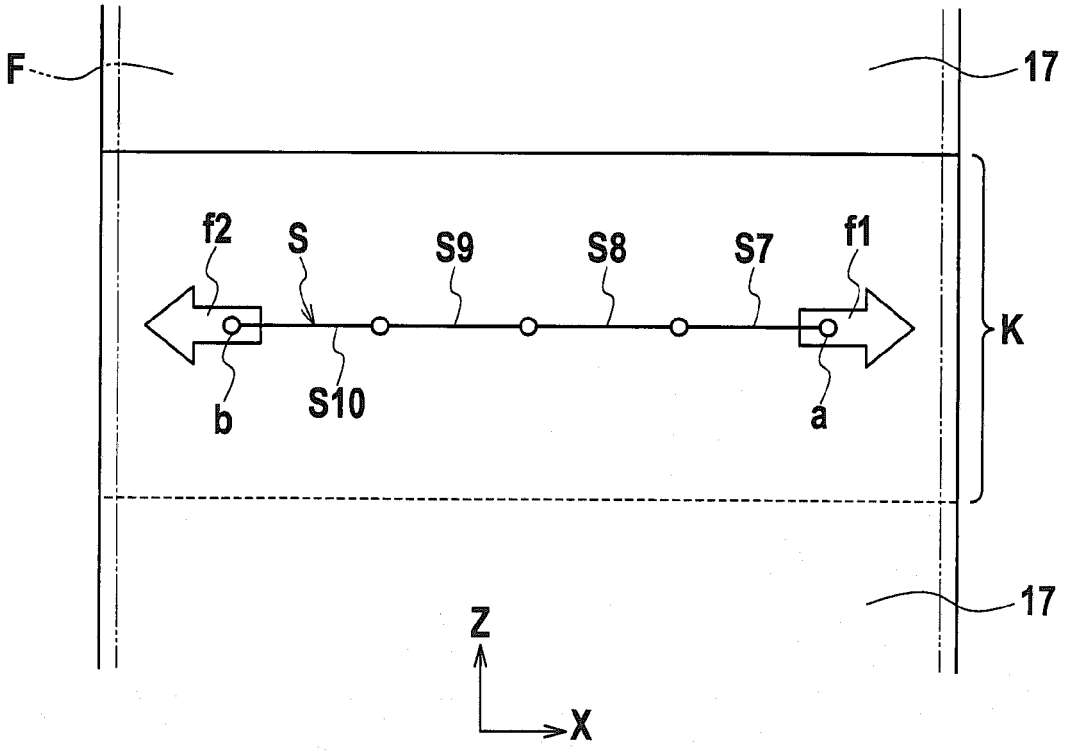
FIG. 2 is an explanatory diagram of an operation of the conventional technique.

The palm member 101 and the hand-back member 102 both have, for example, a finger-palm member 104 and a finger-back member corresponding to an index finger, a middle finger, a ring finger, and a little finger and the finger-palm member 104 and the finger-back member 105 are sewn together at the right and left positions on the side of the finger-back member 105 as shown schematically (corresponding to FIG. 2, FIG. 5(C), and FIG. 7(C) in the Japanese patent brochure of the Japanese Utility Model Registration No. 3122530 (the Japanese patent brochure of Patent Application laid-open No. 2007-277801) previously mentioned in the Disclosure of the Invention).

As shown in FIG. 3 in the present application, the finger-palm member 104 is structured by a plurality of finger-palm portions, for example, the first finger-palm portion 104A, the second finger-palm portion 104B, and a ring finger-palm portion 104C.

Figure 7:
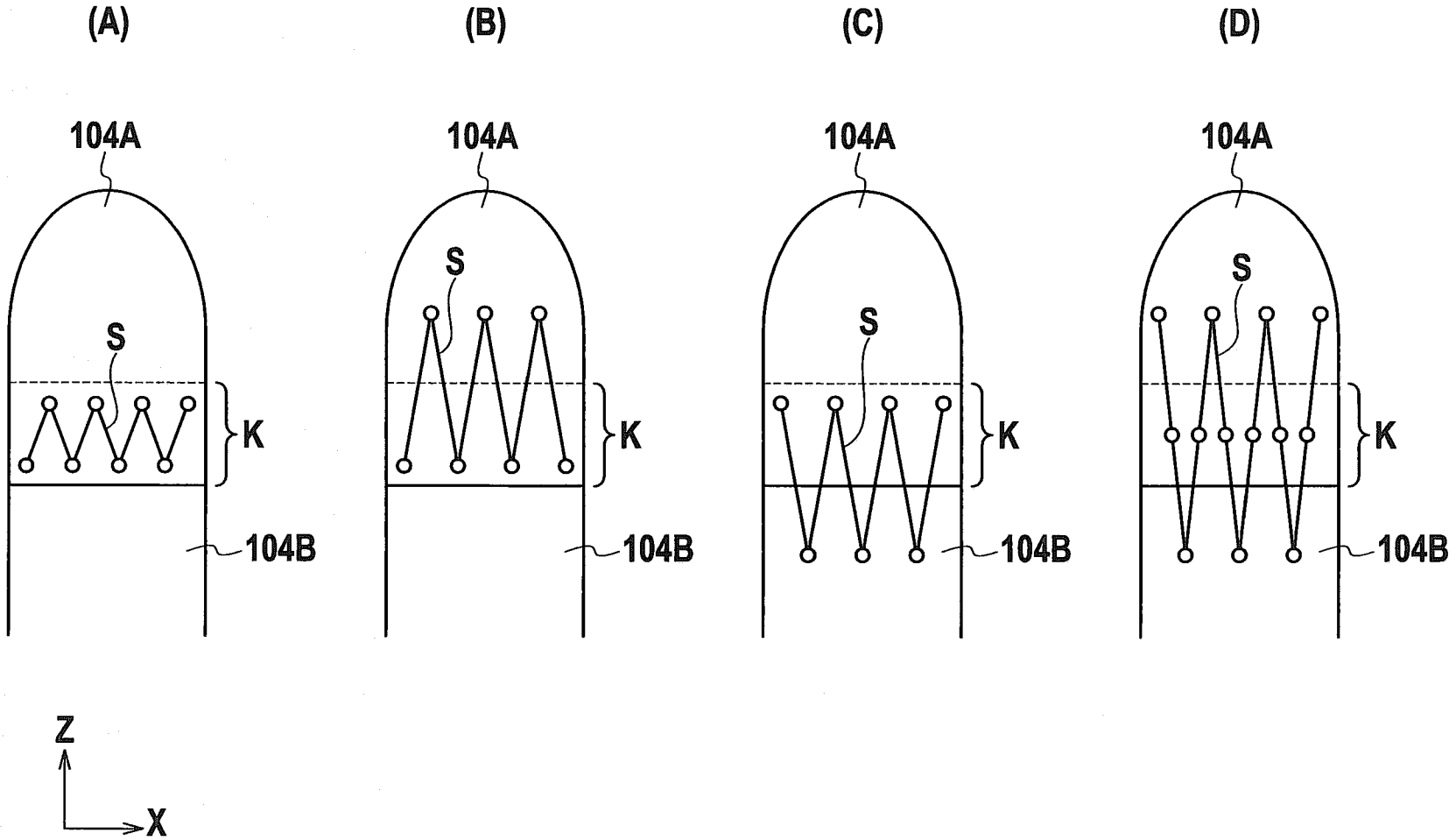
FIGS. 7(A), (B), (C), and (D) are diagrams showing another example of sewing according to the present invention.
Figure 8:
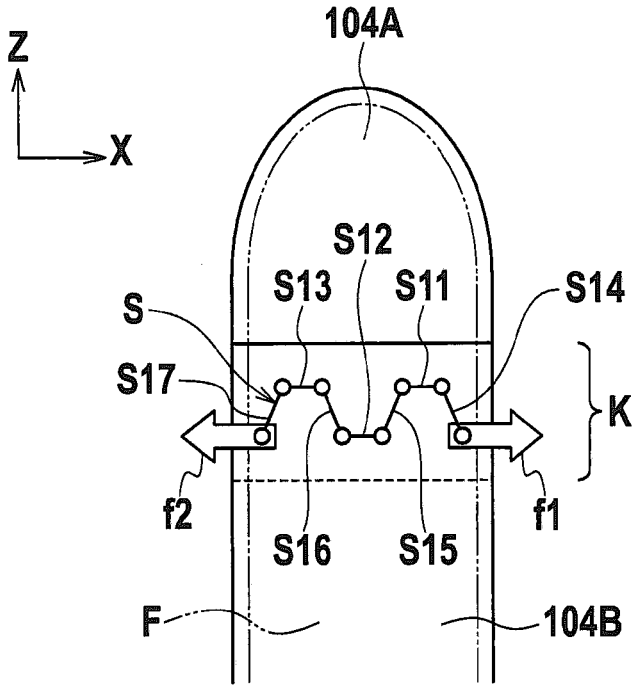
FIGS. 8(A) and (B) are diagrams showing still another example of sewing according to the present invention.
Figure 8:
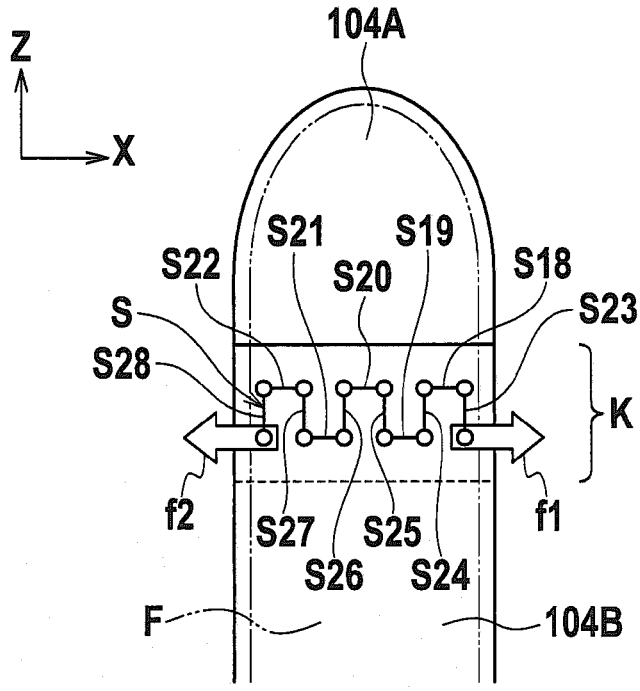

In a state where the finger-palm portions 104A, 104B, and 104C are bent into a U-shape (corresponding to FIG. 7(C) in the patent brochure mentioned above), concave-arc-shaped edges in opposition to each other are sewn together (corresponding to FIG. 8 in the patent brochure). Due to this structure, it is possible for the whole finger pocket to bend toward the palm side at the positions corresponding to the interphalangeal joint portions Fa when the finger pocket structured by the finger-palm member 104 and the finger-back member 105 is put on the finger F of the hand as shown, for example, in FIG. 4(A) of the present application.

Figure 6:
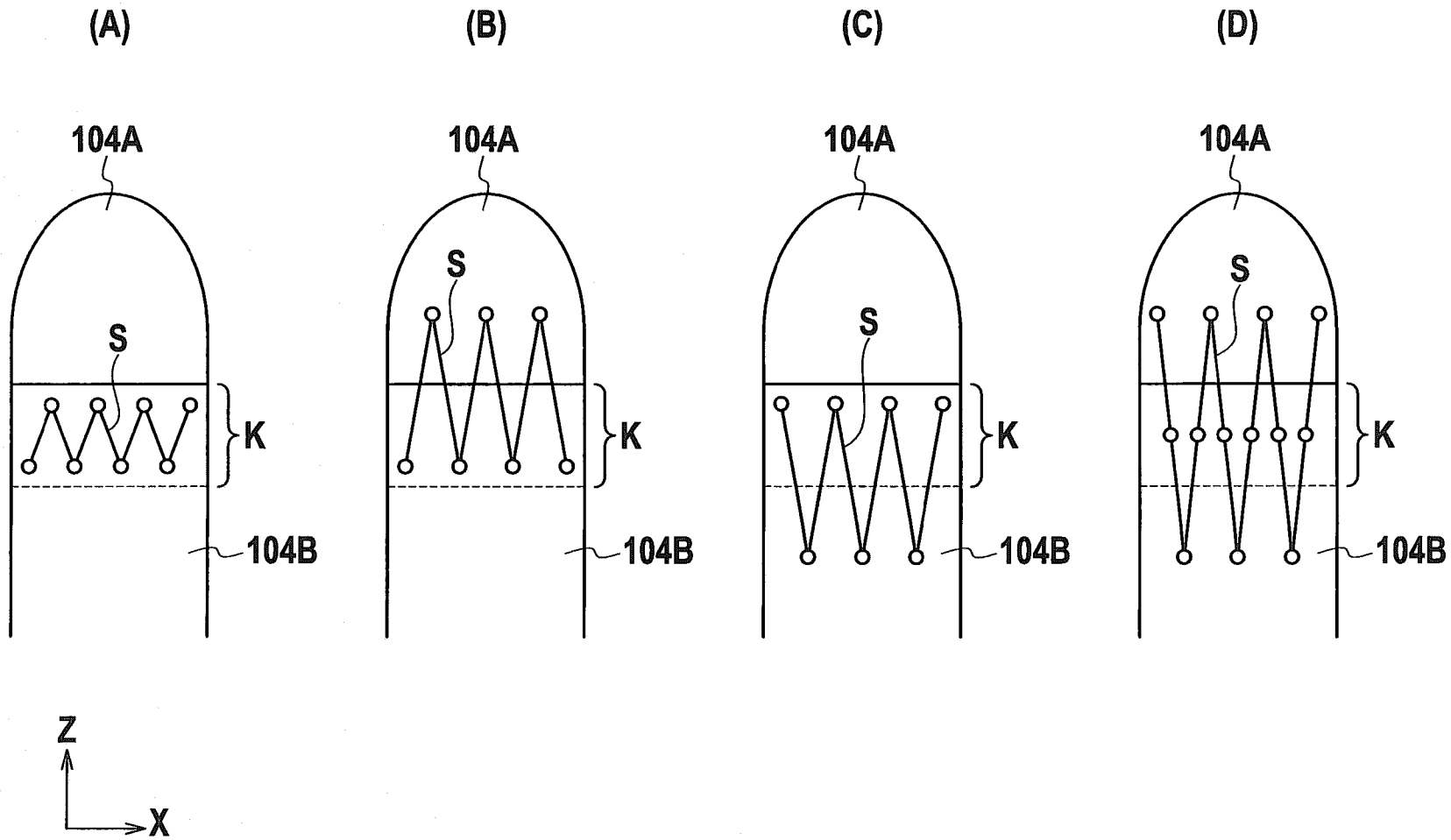
FIGS. 6(A), (B), (C), and (D) are diagrams showing an example of sewing according to the present invention.

When this state is viewed from the palm side, the overlapping portion K is formed, for example, by overlapping the inner finger-palm portion 104B on the outer finger-palm portion 104A and the region including the overlapping portion K is sewn together in a zigzag manner with the thread S, as shown in FIG. 6 of the present application.

For example, FIG. 6(A) shows a case that only the overlapping portion K present on the palm side is sewn, FIG. 6(B) shows a case that the outer finger-palm portion 104A and the overlapping portion K are sewn together, FIG. 6(C) shows a case that the overlapping portion K and the inner finger-palm portion 104B are sewn together, and FIG. 6(D) shows a case that the outer finger-palm portion 104A, the overlapping portion K, and the inner finger-palm portion 104B are sewn together in a zigzag manner with the thread S, respectively.

Figure 5:
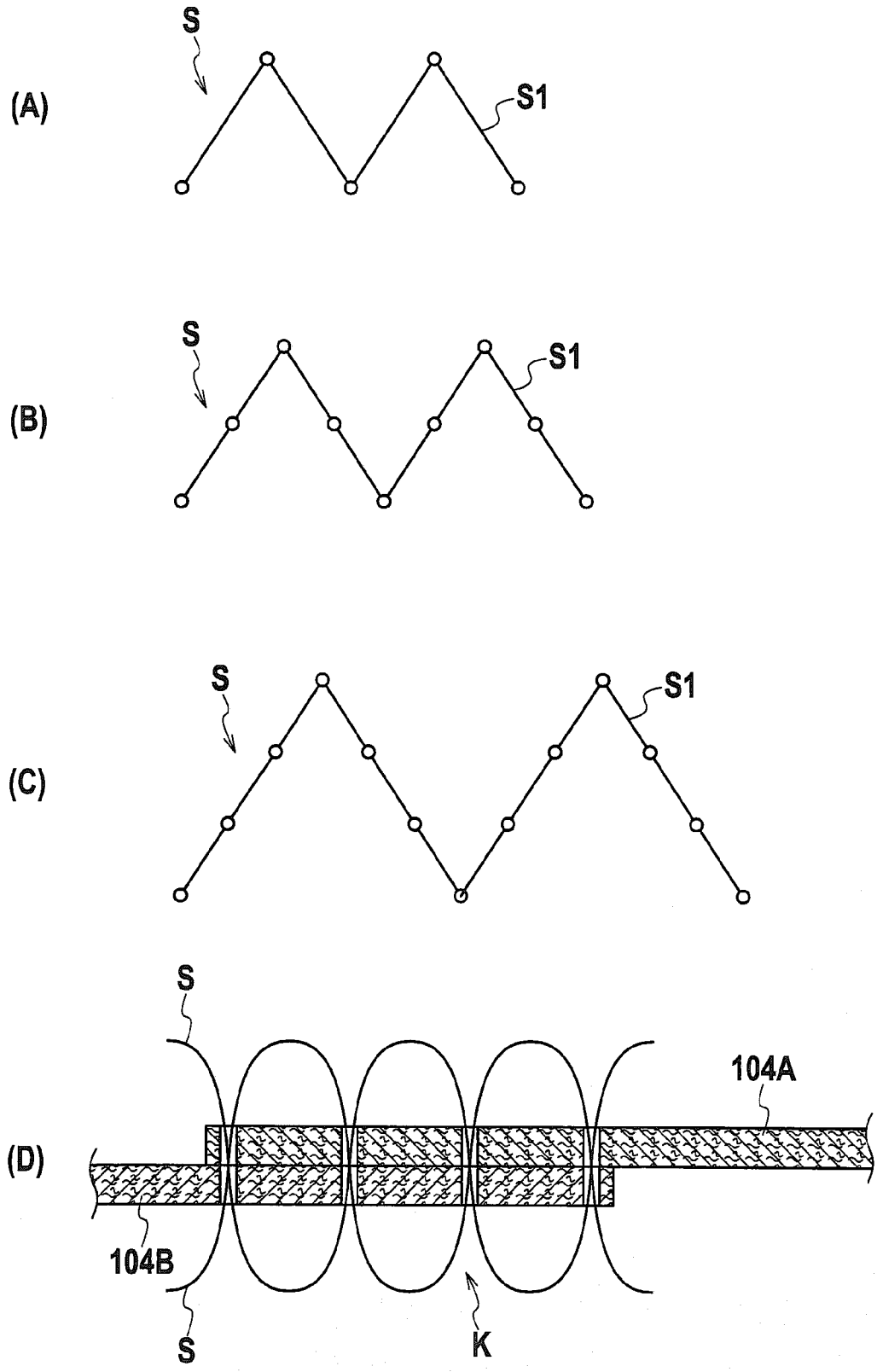
FIGS. 5(A), (B), (C), and (D) are diagrams showing seams according to the present invention.

The number of seams is not fixed, as shown in FIG. 5, but determined by taking into consideration the use of the sewn glove of the present invention.

FIG. 5(A) shows a case that the number of seams of the parallel part S1 of a parallel movement mechanism formed by sewing with the thread S is two, FIG. 5(B) shows a case that the number of seams is three in the same state, and FIG. 5(C) shows a case that the number of seams is four in the same state, respectively.

As to the number of threads 5, it is preferable to use the two treads S instead of the one thread S, as shown, for example, in FIG. 5(D), and thereby, the region including the overlapping portion K to be sewn with the thread S is reinforced.

Figure 4:
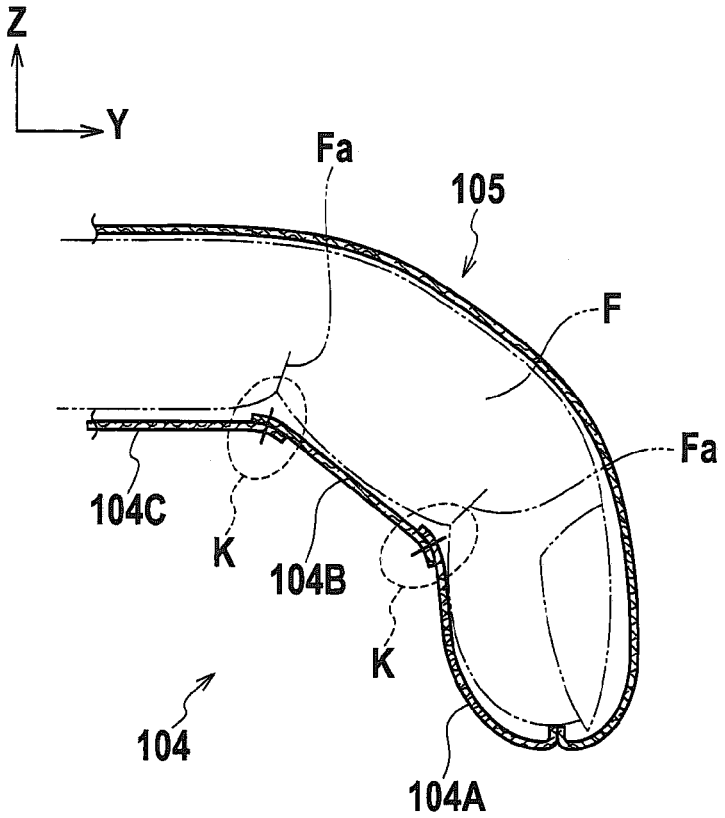
FIGS. 4(A) and (B) are cross-sectional views of FIG. 3.
Figure 4:
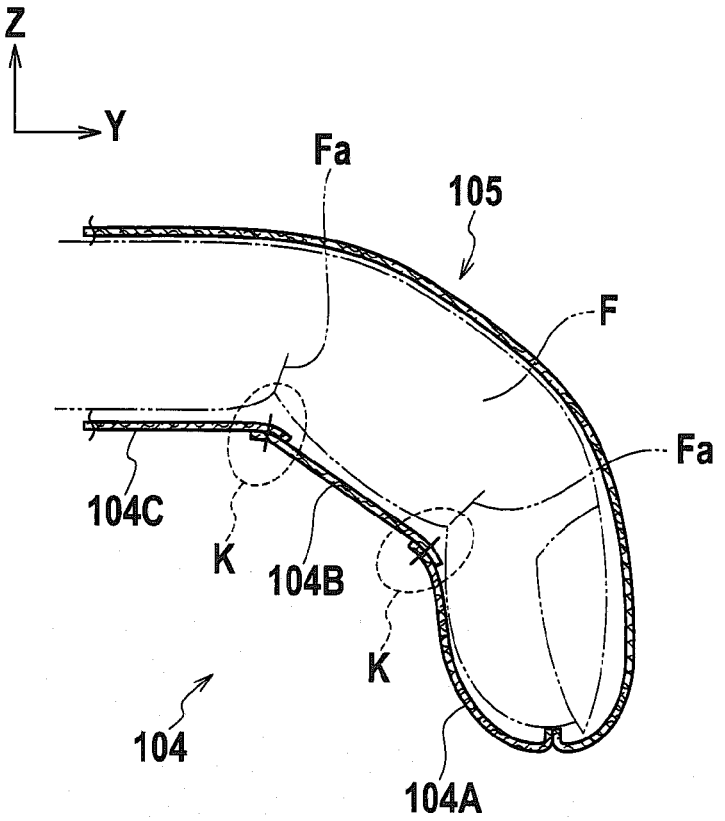

FIG. 7 is a diagram when the state in FIG. 4(B) is viewed from the palm side, and the overlapping portion K is formed, for example, by overlapping the outer finger-palm portion 104A on the inner finger-palm portion 104B and then the region including the overlapping portion K is sewn together in a zigzag manner with the thread S.

Similarly, for example, FIG. 7(A) shows a case that only the overlapping portion K is sewn, FIG. 7(B) shows a case that the outer finger-palm portion 104A and the overlapping portion K are sewn together, FIG. 7(C) shows a case that the overlapping portion K and the inner finger-palm portion 104B are sewn together, and FIG. 7(D) shows a case that the outer finger-palm portion 104A, the overlapping portion K, and the inner finger-palm portion 104B are sewn together in a zigzag manner with the thread S, respectively.

In the case of FIG. 7 also, the number of seams is not fixed (FIG. 5), but determined by taking into consideration the use of the sewn glove of the present invention (FIG. 5(A) to FIG. 5(C)) and it is preferable to use the two treads S for sewing (FIG. 5(D)), and thereby, the region including the overlapping portion K to be sewn with the thread S is reinforced.

FIG. 8 is a diagram showing still another example of the sewing according to the present invention.

As the sewing in a zigzag manner shown in FIG. 6 and FIG. 7 is called wave-type sewing, that in FIG. 8(A) is called trapezoid-type sewing and that in FIG. 8(B) is called rectangle-type sewing.

Figure 1:
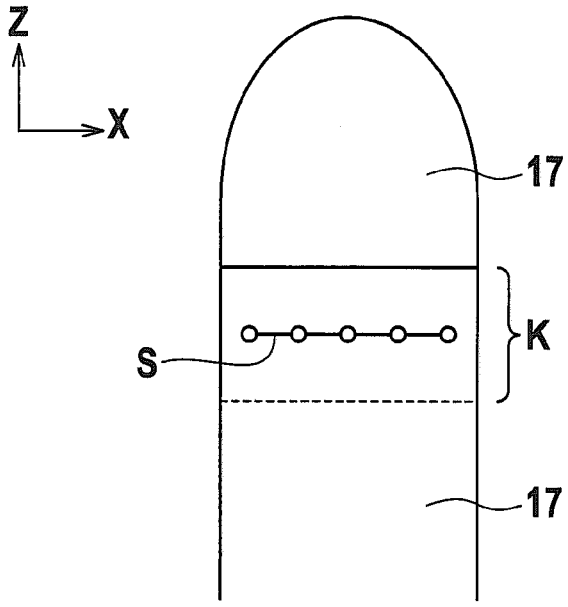
FIG. 1 is an explanatory diagram of a structure of a conventional technique.

If conventional sewing (FIG. 1, FIG. 2) is called line-type sewing including only line parts in the horizontal direction (X-axis direction), the trapezoid-type sewing in FIG. 8(A) forms a mixed elastic movement mechanism including line parts S11 to S13 in the horizontal direction and inclined parts S14 to S17 inclined with respect to the line parts and the rectangle-type sewing in FIG. 8(B) forms a mixed elastic movement mechanism including line parts S18 to S22 in the horizontal direction and line parts S23 to S28 perpendicular (Z-axis direction) to the line parts.

While only line parts S7 to S10 in the horizontal direction (X-axis direction) are included in the conventional technique (FIG. 1, FIG. 2), the inclined parts S14 to S17 (FIG. 8(A)) and the vertical (in the Z-axis direction) line parts S23 to S28 (FIG. 8(B)) are included in the case of FIG. 8, and therefore, when the glove is put on the hand, the sewed portion is ready to move to the right and left (in the X-axis direction) according to the external forces f1 and f2 from the finger F of the hand.

The operations of the present invention having the above-mentioned structure are explained below.

For example, it is assumed that the overlapping portion K is formed by overlapping the inner finger-palm portion 104B on the outer finger-palm portion 104A (FIG. 4(A)) and only the overlapping portion K is sewn in a zigzag manner as shown in FIG. 6(A).

Figure 9:
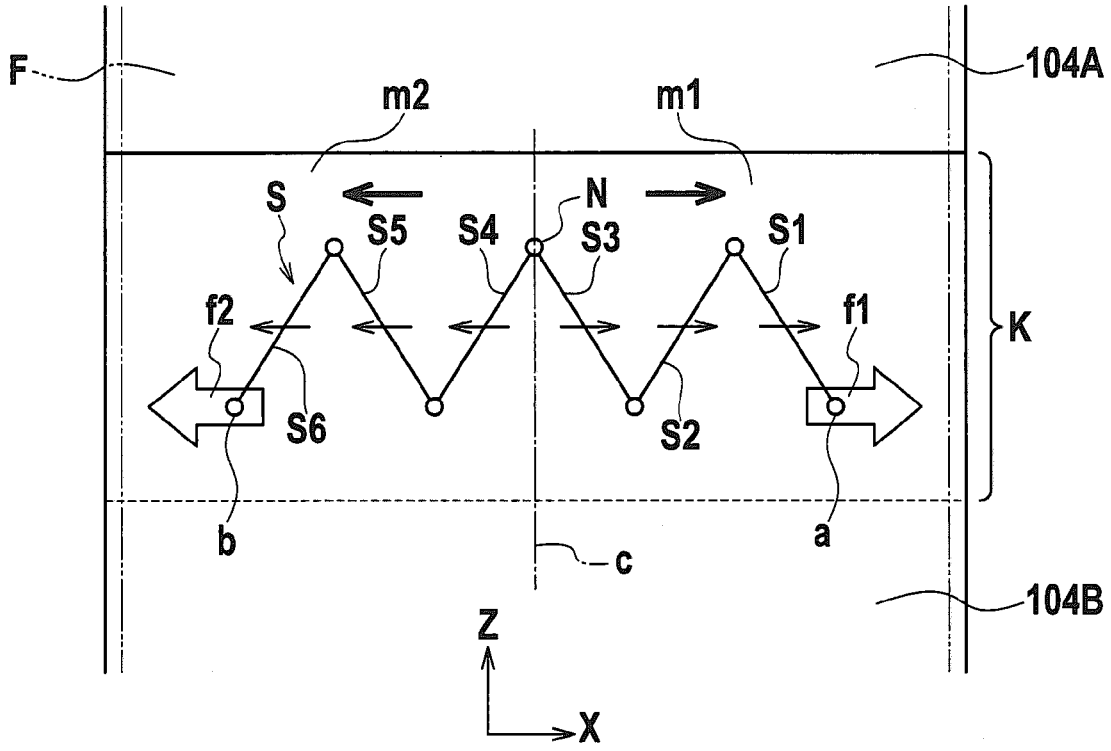
FIG. 9 is an explanatory diagram of an operation of the present invention.

With this assumption, as shown in FIG. 9, the inclined parts S1, S2, and S3, and S4, S5, and S6 of the sewn thread S form the elastic movement mechanism and further the finger-palm portions 104A and 104B are in general made of cloth or skin and excellent in flexibility as conventionally, and therefore, the overlapping portion is ready to bend as a whole.

When such a sewn glove according to the present invention is put on a hand, the external forces f1 and f2 in the horizontal direction (X-axis direction) are applied from the finger F of the hand with the seams on both ends of the whole thread S forming the elastic movement mechanism as the application points a and b.

As a result, the inclined parts S1, S2, and S3 of the elastic movement mechanism move to the right and the inclined parts S4, S5, and S6 move to the left, respectively, with the seam N in the center of the thread S as the center c.

Accordingly, according to the movement of the inclined parts S1, S2, and S3, and S4, S5, and S6 of the elastic movement mechanism, the right side part m1 and the left side part m2 of the flexible overlapping portion K are also allowed to move in the horizontal direction (X-axis direction).

Consequently, according to the present invention, there is an effect that the sewn glove is made to be easy and comfortable to wear when the sewn glove is put on a hand by extending or bending the sewn glove so that it fits the fingers of the hand.

Figure 15:
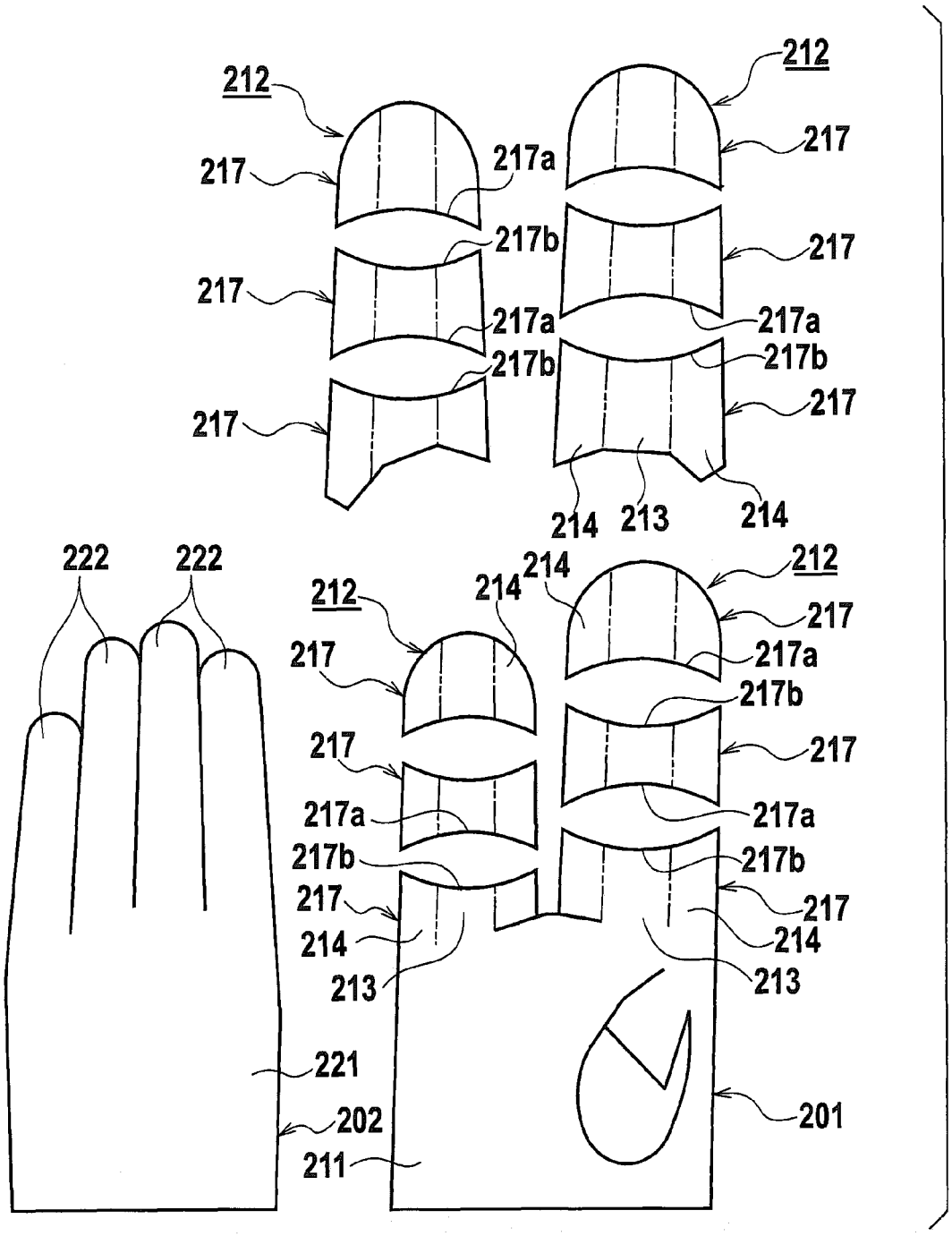
FIG. 15 is an exploded view of a palm member and a hand-back member used for a sewn glove according to a second embodiment.
Figure 16:
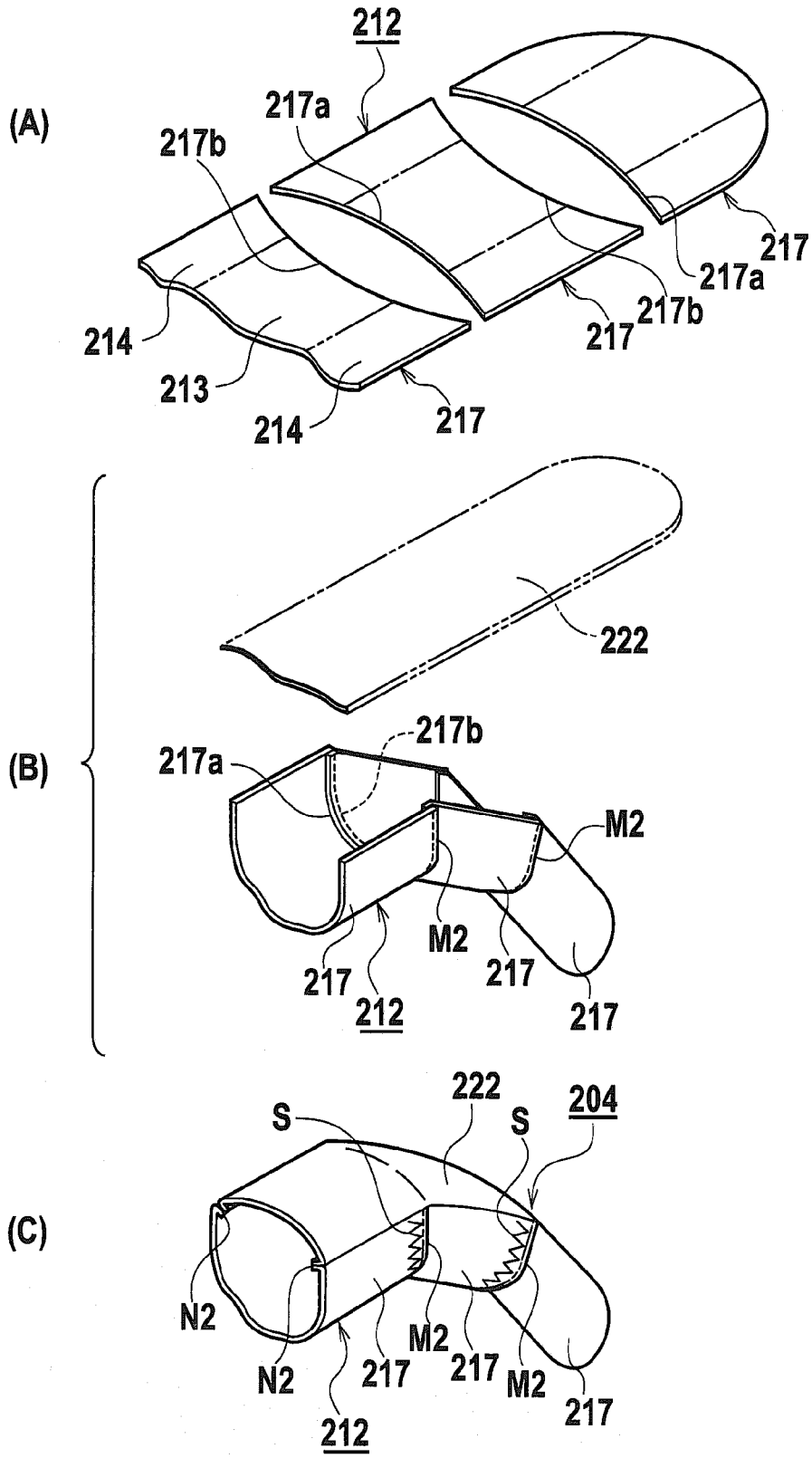
FIGS. 16(A), (B), (C) are explanatory diagrams of a sewing method of a finger pocket portion of the sewn glove according to the second embodiment (FIG. 15).
Figure 17:
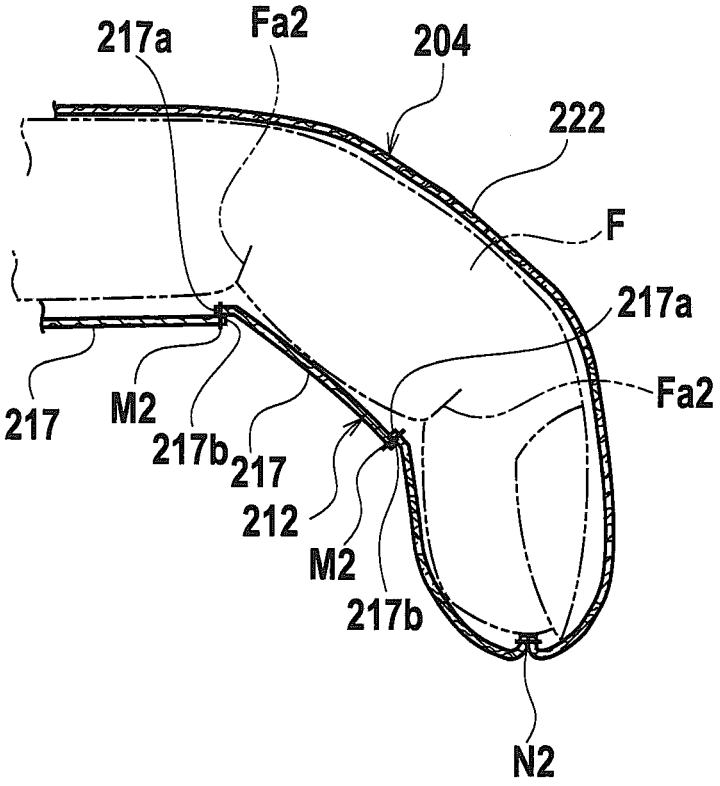
FIG. 17 is a cross-sectional view in the lengthwise direction of the finger pocket portion of the sewn glove according to the second embodiment.

With reference to FIG. 10 to FIG. 17, in the glove disclosed in the patent brochure previously mentioned in the Disclosure of the Invention, a sewn glove which is sewn in a zigzag manner at the seams of the palm members as described above, is explained below in detail. FIG. 10 to FIG. 14 show the sewn glove according to the first embodiment and FIG. 15 to FIG. 17 show the sewn glove according to the second embodiment.

First Embodiment in FIG. 10 to FIG. 14

Figure 10:
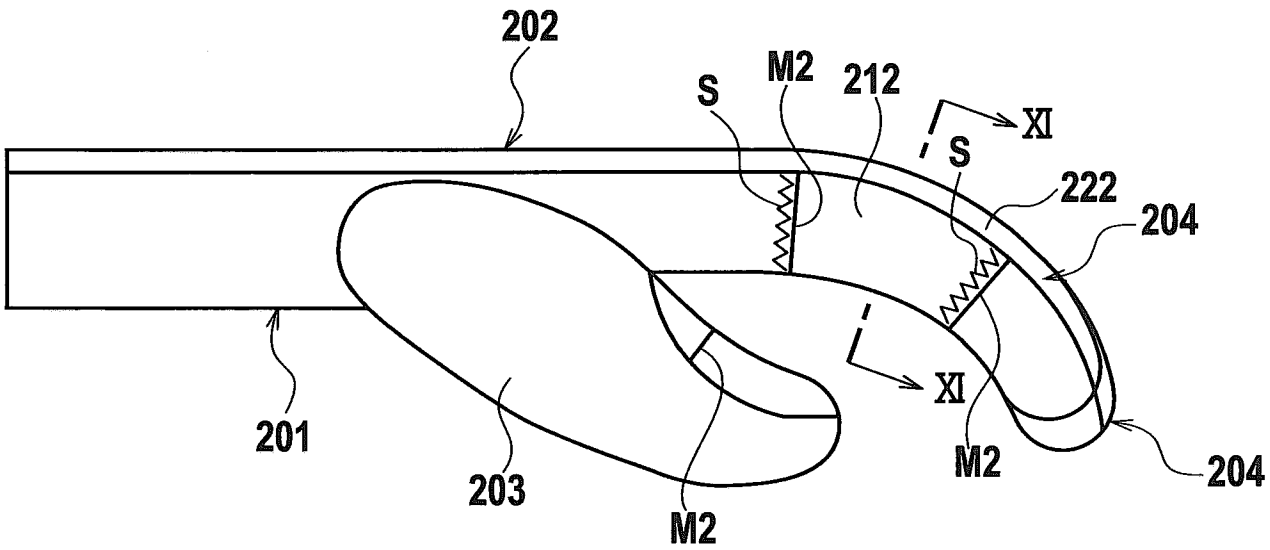
FIG. 10 is a side view when a sewn glove according to a first embodiment is viewed from the thumb pocket side.

As shown in FIG. 10, the sewn glove according to the first embodiment is sewn using a palm member 201, a hand-back member 202, and a thumb pocket member 203 as a base member. That is, the sewn glove according to the first embodiment is sewn, as shown in FIG. 10, using the palm member 201 and the hand-back member 202 shown in FIG. 13, and the thumb pocket member 203 made of a different material.

As these materials (the palm member 201, the hand-back member 202, and the thumb pocket member 203), hide or synthetic leather is mainly used. The sewn glove used in the present application is comparatively thick and used mainly as a glove for ski or motorcycling and applied to that used to grasp a grip, however, the sewn glove can also be applied to a comparatively thin one for golf or batting.

Figure 13:
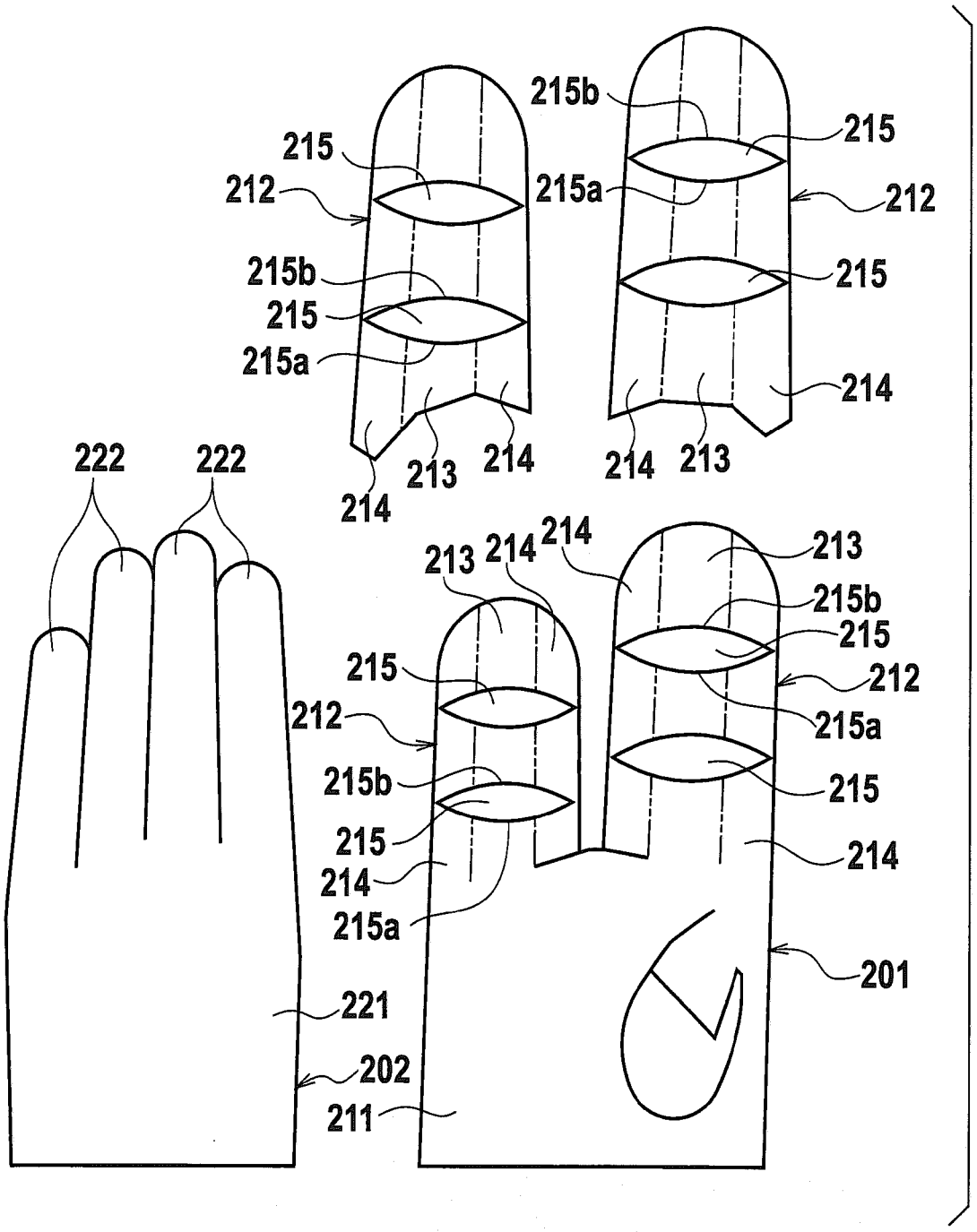
FIG. 13 is an exploded view of a palm member and a hand-back member used for the sewn glove in FIG. 10.
Figure 14:
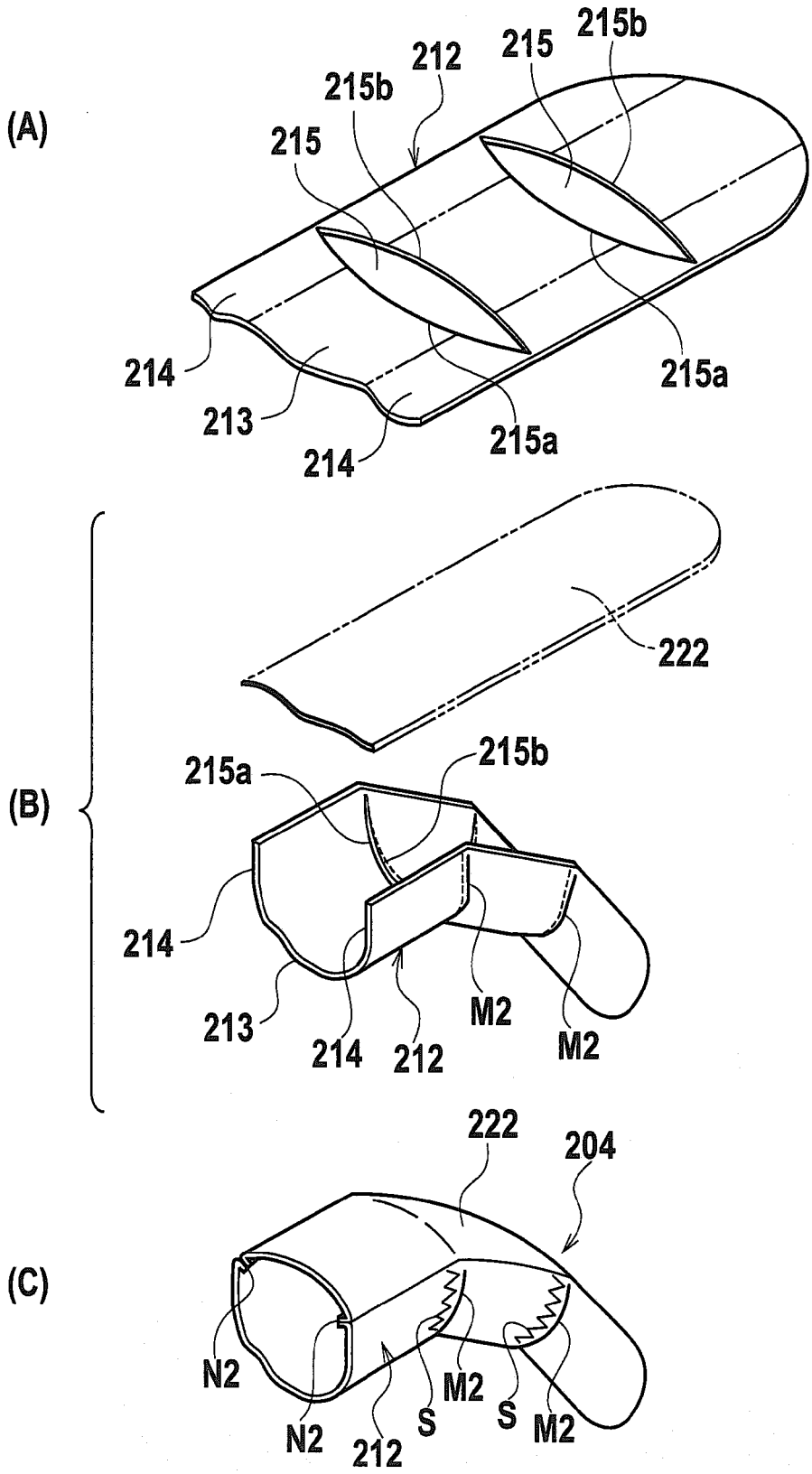
FIGS. 14(A), (B), (C) are explanatory diagrams of a sewing method of the finger pocket portion of the sewn glove in FIG. 10.

FIG. 13 is a plan view of a state where the palm member 201 and the hand-back member 202 are cut. The palm member 201 is cut into a so-called gun-cut type, that is, a palm portion 211 is cut together with two finger-palm members 212 and 212 for the index finger and the little finger and at the same time, the finger-palm members 212 and 212 for the middle finger and the ring finger are cut separately. The hand-back member 202 is cut into a palm portion 221 together with the four finger-back members 222, 222, . . . , for the fingers from the little finger to the index finger.

The four finger-palm members 212, 212, . . . , have each a width wide enough to cover the palm surface and the right and left sides of each finger. That is, each of the finger-palm members 212 is cut so that it has a width having side covering portions 214 and 214 on both right and left sides of a palm surface covering portion 213, respectively.

In the four finger-palm members 212, 212, . . . , substantially elliptic holes 215 and 215 are punched out and formed in two parts, respectively, at the positions corresponding to the two interphalangeal joint portions (a first interphalangeal joint portion and a second interphalangeal joint portion) with a part (about 0.5 to 1 mm) left uncut on both edges of the finger-palm member 212, as shown in FIG. 13 and FIG. 14(A). In each of the substantially elliptic holes 215 and 215, concave-arc-shaped edges 215*a* and 215*b* are formed, respectively, at positions in opposition to each other. Because each of the substantially elliptic holes 215 is formed in a state where a part on both edges of the finger-palm member 212 is left uncut, each of the finger-palm members 212, 212, is continuous as a single member. That is, each of the substantially elliptic holes 215 is provided so that it not only covers the palm surface covering portion 213 of the finger-palm member 212 but also extends (reaches) as far as each of the side covering portions 214 and 214 present on both right and left sides of the palm surface covering portion 213.

Each of the substantially elliptic holes 215 and 215 is used to bend the finger pocket toward the palm side at the position corresponding to an interphalangeal joint portion Fa2 (FIG. 12), as will be described later, however, in the first embodiment, each of the substantially elliptic holes 215 is formed in each of the four finger-palm members 212, 212, in two parts, as shown in FIG. 13. For example, for a glove used for motorcycling, only two fingers, that is, the little finger and the ring finger, are bent toward the palm side and in this case, the substantially elliptic hole 215 can be formed only in each of the finger-palm members of the little finger and the ring finger. Alternatively, in the case that the thumb pocket 203 (FIG. 10) is also bent inward, a substantially elliptic hole is formed also in a finger-palm member of the thumb pocket at a position corresponding to the interphalangeal joint portion of the thumb.

In each of the substantially elliptic holes 215 and 215 of the finger-palm member 212, the concave-arc-shaped edges 215*a* and 215*b* are arranged in opposition to each other. It is then possible to bend the finger-palm member 212 toward the palm side as shown in FIG. 14(B) by sewing together the concave-arc-shaped edges 215*a* and 215*b* of the substantially elliptic holes 215 along each of the concave-arc-shaped edges. The depth of the concave-arc portion of each of the concave-arc-shaped edges 215*a* and 215*b* is determined depending on how much the position corresponding to the interphalangeal joint portion of the thumb pocket is bent, and the deeper the concave-arc portion is, the more the thumb pocket interphalangeal joint portion can be bent.

The sewn glove according to the first embodiment is sewn using the finger-palm member 201 and the hand-back member 202 shown in FIG. 13, and the thumb pocket member 203 shown in FIG. 10, and in this case, each finger pocket 204 of the little finger to the index finger is sewn as shown in FIGS. 14(A) to (C).

That is, FIG. 14(A) shows a state where the finger-palm member 212 is expanded, and the finger-palm member 212 is cut integrally so that the finger-palm surface covering portion 213 and the finger-palm side covering portions 214 and 214 on both right and left sides thereof form a single unit. From the expanded state, as shown in FIG. 14(B), the finger-palm member 212 is bent into a U-shape in the direction of width and at the same time, the concave-arc-shaped edges 215*a* and 215*b* in opposition to each other of the substantially elliptic holes 215 and 215 are sewn together in a zigzag manner along each of the concave-arc-shaped edge as described above.

Sewing the concave-arc-shaped edges 215*a* and 215*b* of the substantially elliptic hole 215 as described above will cause the substantially elliptic hole 215 to become thinner, and therefore, the finger-palm member 212 bends toward the palm side at sewn portions M2 and M2 of the concave-arc-shaped edges 215*a* and 215*b*.

The right and left edges of the finger-palm member 212 and the right and left edges of the finger-back member 222 are then sewn (sewn portions N2 and N2) as shown from the state in FIG. 14(B) to that in FIG. 14(C), and thus, the finger pocket 204 is sewn into its shape. At each of the sewn portions M2 and N2, the material is sewn from, for example, its backside (it can be sewn from the surface side). Other parts of the palm member 201 and the hand-back member 202 and the thumb pocket member 203 are sewn normally in a conventional manner and they are sewn into the glove in FIG. 10. In the first embodiment in FIG. 10, the same process (at the sewn portion M2 of the concave-arc-shaped edges of the substantially elliptic hole) as that described above is applied to the position corresponding to the interphalangeal joint portion of the thumb pocket 203 in order to bend the portion toward the palm side.

Figure 11:
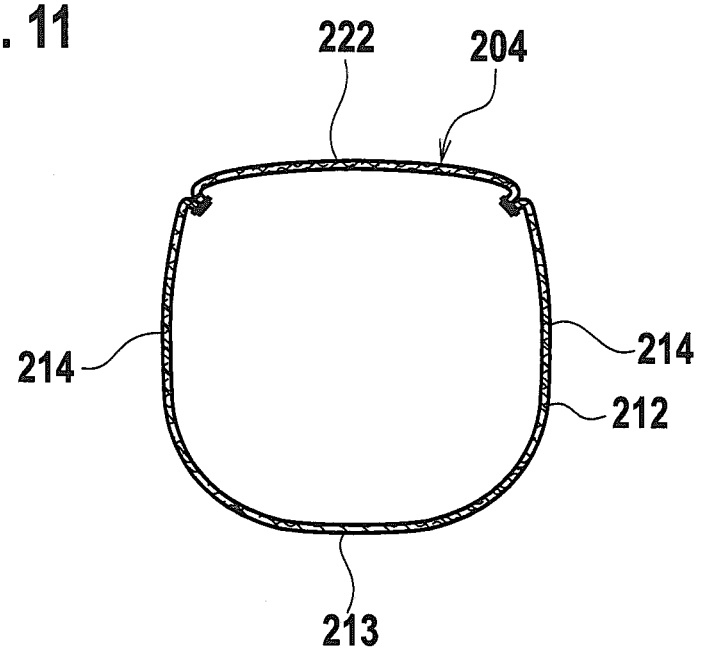
FIG. 11 is an enlarged cross-sectional view of FIG. 10 along XI-XI.

The sewn glove according to the first embodiment uses a gore material to cover the region corresponding to the side of a finger, as in the conventional technique disclosed in the patent brochure previously mentioned in the Disclosure of the Invention, and the finger-palm member 212 and the finger-back member 222 are sewn only at the right and left position of the finger-back side, and therefore, there is no sewn portion of the finger-palm member 212 and the finger-back member 222 on the finger-palm side as shown in FIG. 11. As a result, when the glove is put on a hand to grasp a grip, the feeling of wearing is good without an uncomfortable feeling because there is no sewn portion of the finger-palm member 212 and the finger-back member 222 between the fingers and the grip. In addition, because it is possible to bend the finger pocket 204 toward the palm side in a state where there is no sewn portion on the finger-palm side of each of the finger pockets 204, when the sewn glove is put on a hand to grasp a grip, it is possible to grasp the grip with a small bending force in the state where there is no uncomfortable feeling that would be caused by the sewn portion.

Figure 12:
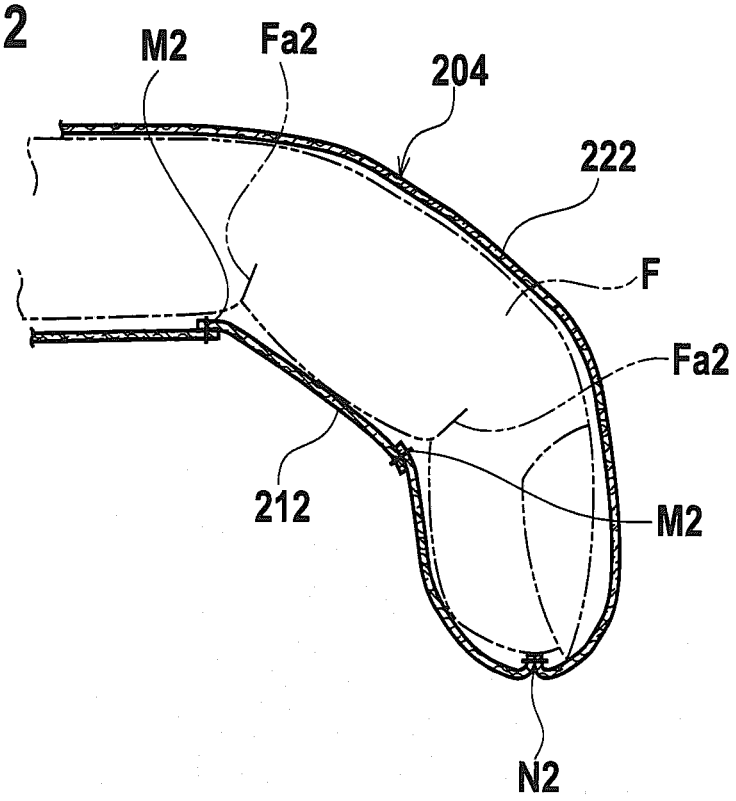
FIG. 12 is a cross-sectional view in the lengthwise direction of a finger pocket portion of the sewn glove in FIG. 10.

Further, because it is possible to sew the concave-arc-shaped edges 215*a* and 215*b* of the finger-palm member 212 in a state where the concave-arc-shaped edges 215*a* and 215*b* on both sides are overlapped vertically, the sewn portion M2 of the concave-arc-shaped edges 215*a* and 215*b* becomes planar (there is no part that protrudes into the finger pocket) as shown in FIG. 12, and therefore, when the glove is put on a hand, there will be no longer the uncomfortable feeling at the sewn portions M2 and M2 for bending the finger pockets.

Furthermore, because the parts of a finger are already bent inward, a difference in level at the seam of the finger-palm side (at which the finger-palm members 12 are sewn together) is likely to appear in the case of straight sewing, but not in the case of zigzag sewing.

Second Embodiment in FIG. 15 to FIG. 17

A sewn glove according to a second embodiment shows a modification of the part of the finger-palm member 212. The whole shape of the sewn glove according to the second embodiment is the same as that in FIG. 10.

In the sewn glove of the second embodiment, as shown in FIG. 15 and FIG. 16(A), the four finger-palm members 212, 212, . . . , are divided into a plurality of (three) divided finger-palm members 217, 217, and 217 at positions corresponding to the interphalangeal joint portions, respectively. The edge of the divided portion of each of the divided finger-palm members 217, 217, and 217 is shaped into a concave-arc-shaped edge (217*a* or 217*b*), respectively. The divided finger-palm members 217, 217, and 217 of the finger-palm members 212, 212, . . . , are separated at the substantially elliptic hole part of the finger-palm member in the first embodiment described above and other structures are the same as those in the first embodiment.

In the sewn glove of the second embodiment, the four parts of finger pockets are sewn as shown in FIGS. 16(A) to (C).

The three divided finger-palm members 217, 217, and 217 in the expanded state shown in FIG. 16(A) are first bent into a U-shape in the direction of width and at the same time, the concave-arc-shaped edges 217*a* and 217*b* in opposition to each other of the finger-palm members 217 and 217 are sewn together along the concave-arc-shaped edges as shown in FIG. 16(B). In the sewn glove of the second embodiment, the tip portions of the concave-arc-shaped edges 217*a* and 217*b* are sewn together in the state where they are overlapped vertically (see the sewn portion M2 in FIG. 17). Although not shown clearly in FIG. 17, sewing is done in a zigzag manner, for example, as described previously (for example, see FIG. 3). Sewing the concave-arc-shaped edges 217*a* and 217*b* of the finger-palm members 217 and 217 on both sides in this manner will cause the finger-palm member 212 to be continuous at the sewn portion M2 in the state of being bent toward the palm side.

The right and left edges of the finger-palm member 212 and the right and left edges of the finger-back member 222 are then sewn together (sewn portions N2 and N2) as shown from the state in FIG. 16(B) to that in FIG. 16(C), and thus, the finger pocket 204 is sewn into its shape. The sewing of other parts is the same as that in the first embodiment.

Also in the case of the sewn glove according to the second embodiment, as in the first embodiment, there is no sewn line of the finger-palm member 212 and the finger-back member 222 at the finger-palm part of the finger pocket 204 and it is possible to sew each of the finger pockets 204 in the state where it bends toward the palm side, and therefore, a feeling of wearing the glove becomes excellent and only a small bending force is required.

Furthermore, in the case of the second embodiment, because it is possible to sew the concave-arc-shaped edges 217*a* and 217*b* of the plurality of (three) divided finger-palm members 217, 217, and 217 in a state where the concave-arc-shaped edges 217*a* and 217*b* on both sides are overlapped vertically, the sewn portion M2 of the concave-arc-shaped edges 217*a* and 217*b* becomes planar (there is no part that protrudes into the finger pocket) as shown in FIG. 17, and therefore, when the glove is put on a hand, there will be no longer the uncomfortable feeling that would be caused by the sewn portions M2 and M2 for bending the finger pockets.

Further, because the parts of a finger are already bent inward, a difference in level at the seam of the finger-palm side (at which the finger-palm members 12 are sewn together) is likely to appear in the case of straight sewing, but not in the case of zigzag sewing.

Figure 18:
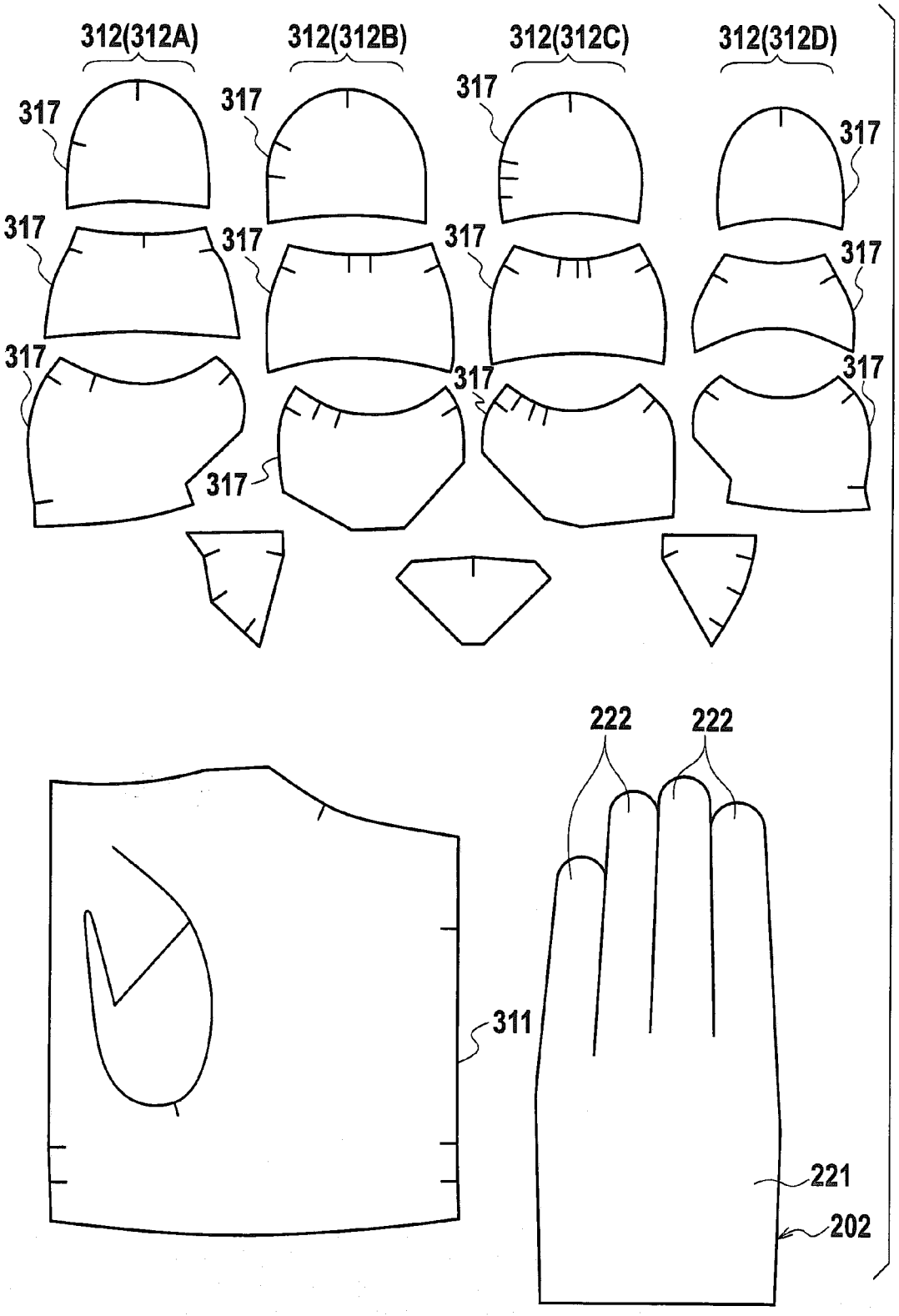
FIG. 18 is an exploded view of a palm member and a hand-back member used for a sewn glove according to a third embodiment.

Note that, in a third embodiment, all finger-palm members (finger-palm members structured to include each divided finger-palm member 217) 312 can be provided separately from a palm portion (palm portion corresponding to the palm portion 211 in FIG. 15) (see FIG. 18). A finger-palm member 312A shown in FIG. 18 is a finger-palm member for an index finger, a finger-palm member 312B is a finger-palm member for a middle finger, a finger-palm member 312C is a finger-palm member for a ring finger, and a finger-palm member 312D is a finger-palm member for a little finger.

Similarly, in the first embodiment shown in FIG. 13, all of the finger-palm members 212 can be provided separately from the palm portion 211.

The present invention is not limited to the above or aforementioned embodiments of the invention, and various other embodiments can be made by appropriate modifications.

Note that the entire contents of Japanese Patent Application No. 2007-166524 (filed on Jun. 25, 2007) and Japanese Patent Application No. 2007-293623 (filed on Nov. 12, 2007) are incorporated herein by reference.

INDUSTRIAL APPLICABILITY

The present invention can be used for the sewn glove with finger pocket portions, which have been bent toward the palm side so that it easily grasps a ski pole, a motorcycle handgrip, a golf club, a baseball bat, etc., and the manufacturing method thereof. In particular, the present invention is remarkably useful for making the sewn glove easier and more comfortable to wear when the sewn glove is put on a hand by extending the sewn glove so that it fits the fingers of the hand.

The invention claimed is:

1. A sewn glove comprising:

a palm member with a hand-back side and a palm side; and a plurality of finger pockets extending outward from the palm member;

wherein, the palm member and the plurality of finger pockets are formed and arranged to substantially cover a hand and plurality of fingers of a wearer of the glove, wherein the hand-back side is configured to cover a back side of a wearer's hand and the palm side is configured to cover a palm side of a wearer's hand and wherein, each of the plurality of finger pockets comprises:

a finger back member, to substantially cover an outer finger surface of one of the plurality of fingers of the wearer when the glove is worn; and a finger palm member, having a right portion, a center portion and a left portion, sewn to the finger back member;

wherein, the center finger palm member portion is configured to substantially cover a palm finger surface, the right finger palm member portion is configured to substantially cover a right finger surface and the left finger palm member is configured to substantially cover a left finger surface of a single finger of the glove wearer; and wherein, one or more of the plurality of finger pockets are formed in an arcuate shape so that the one or more arcuate shaped finger pockets curve toward the palm side of the palm member; and wherein, the one or more arcuate shaped finger pockets are formed by:

making one or more generally elliptic shaped spaces in the center portion of the finger palm members, positioned to correspond to interphalangeal joints of the glove wearer, each generally elliptic shape having a first concave arc shaped edge with a first edge end and a second edge end and a second concave arc shaped edge with a first edge end and a second edge end, the second concave arc shaped edge positioned substantially opposite the first concave arc shaped edge, with the first concave shaped edge and the second concave shaped edge extending from the right portion of the finger palm member to the left portion of the finger palm member, with the first edge end of the first concave arc shaped edge formed to overlap the first edge end of the second concave arc shaped edge and the second edge end of the first concave arc shaped edge formed to overlap the second edge end of the second concave arc shaped edge;

sewing together the overlap of the first edge end of the first concave arc shape edge and the first edge end of the second concave arc shaped edge with a substantially zigzag stitching pattern formed in a first direction;

sewing together the overlap of the second edge end of the first concave arc shaped edge and the second edge end of the second concave arc shaped edge with a substantially zigzag stitching pattern in the first direction;

positioning the first concave arc shaped edge to overlap the second concave arc edge; and sewing together the first concave arc shaped edge and the second concave arc shaped edge in a substantially zigzag pattern formed in a second direction;

wherein, the second direction is generally perpendicular to the first direction; and wherein, the substantially zigzag pattern formed in a second direction extends substantially horizontally along the first and second concave arc shaped edges, with a first end of the zigzag pattern extending substantially vertically beyond the first edge end of the first and second concave arc shaped edge and a second end of the zigzag pattern extending substantially vertically beyond the second end of the first and second concave arc shaped edges.

* * * * *